US008043117B2

(12) United States Patent
Blakborn et al.

(10) Patent No.: US 8,043,117 B2
(45) Date of Patent: Oct. 25, 2011

(54) COAXIAL PLUG CONNECTOR

(75) Inventors: Willem Blakborn, Inzell (DE); Martin Zebhauser, Laufen (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 12/747,370

(22) PCT Filed: Dec. 4, 2008

(86) PCT No.: PCT/EP2008/010301

§ 371 (c)(1),
(2), (4) Date: Jul. 1, 2010

(87) PCT Pub. No.: WO2009/074263

PCT Pub. Date: Jun. 18, 2009

(65) Prior Publication Data

US 2010/0261379 A1 Oct. 14, 2010

(30) Foreign Application Priority Data

Dec. 12, 2007 (DE) ..... 20 2007 017 309 U

(51) Int. Cl.
*H01R 9/05* (2006.01)

(52) U.S. Cl. ..... 439/578; 439/583

(58) Field of Classification Search ..... 439/578, 439/583–585

See application file for complete search history.

(56) References Cited

U.S. PATENT DOCUMENTS

| | | | | |
|---|---|---|---|---|
| 5,548,088 | A * | 8/1996 | Gray et al. | 174/74 R |
| 6,491,542 | B1 | 12/2002 | Zerebilov | |
| 6,769,933 | B2 * | 8/2004 | Bence et al. | 439/578 |
| 7,140,912 | B2 * | 11/2006 | Khemakhem et al. | 439/578 |
| 7,329,149 | B2 * | 2/2008 | Montena | 439/584 |
| 2003/0176104 | A1 | 9/2003 | Hall | |

FOREIGN PATENT DOCUMENTS

| | | |
|---|---|---|
| DE | 4015092 | 11/1991 |
| EP | 0657967 | 6/1995 |
| EP | 1811613 | 7/2007 |
| WO | WO 2005/043683 | 5/2005 |

* cited by examiner

*Primary Examiner* — Thanh Tam Le
(74) *Attorney, Agent, or Firm* — DeLio & Peterson, LLC; Robert Curcio

(57) ABSTRACT

A coaxial plug connector arranged on or at a distance from the plug-sided end of the dielectric of the channel for the inner conductor part. The radial diameter of the channel in the plug-sided end direction narrows from a first to a second predetermined radial diameter. The inner conductor part has a first diameter and a second diameter, which is smaller than the first diameter and smaller than the second predetermined radial diameter. The first diameter is selected such that the inner conductor part fits into the first predetermined radial diameter and simultaneously, is greater than the second predetermined radial diameter, such that a collar is formed. The collar is arranged such that the inner conductor part is located at a predetermined axial position if the collar of the inner conductor part strikes the narrowing radial diameter of the channel.

10 Claims, 2 Drawing Sheets

COAXIAL PLUG CONNECTOR

CROSS REFERENCE TO RELATED APPLICATION

This application is a National Phase filing under 35 U.S.C. §371 of PCT/EP/2008/010301 which was filed Dec. 4, 2008, and claims priority to German Application No. DE 20 2007 017 309.1 filed Dec. 12, 2007.

BACKGROUND OF THE INVENTION

1. Field of the Invention

The invention relates to a coaxial plug connector, particularly a coaxial plug or a coaxial socket comprising an outer conductor part, an inner conductor part, a dielectric which holds the inner conductor part within and coaxial with the outer conductor part at a predetermined axial position, and a plug-side end for plugged electrical and mechanical connection of the inner conductor part and the outer conductor part to a respective inner conductor part and outer conductor part of a complementary coaxial plug connector, wherein the dielectric has an axial channel with a predetermined first radial diameter within which the inner conductor part is arranged.

2. Description of Related Art

In coaxial plug connectors of this type, for assembly of the coaxial plug connector, it is usual to push the inner conductor part axially into the channel of the dielectric until the inner conductor part reaches the axially predetermined position. In this axially predetermined position, the coaxial plug connector has the correct connection dimensions at the plug-side end thereof. However, it can occur, on pushing in the inner conductor part with too great an axial force that the inner conductor part is pushed beyond the axially predetermined position. The coaxial plug connector then becomes damaged and fault-free transmission of HF signals via this coaxial plug connector is no longer possible. In addition, on insertion of this coaxial plug connector with incorrect connection dimensions into a complementary coaxial plug connector, said complementary coaxial plug connector also becomes damaged. Again, the consequence is very poor transmission of HF signals.

US 2003/0176104 A1 discloses a coaxial plug connector which comprises a plastics housing which complies with the FAKRA (Fachkreis Automobiltechnik (Expert Group on Automobile Technology)) standardization scheme for SMB connections. Herein, a plastics housing is provided which holds and protects the plug connector and positions the plug connector for plugging together with another plug connector having a plastics housing. The housing also has mechanical codes so that only matching housings can be plugged into one another.

Plastics housings of this type for coaxial plug connectors, also known as FAKRA housings are used in automotive technology for data transmission cables. These data transmission cables are usually coaxial cables or similar cables based on an electrical conductor. The mechanical dimensions of such FAKRA housings in the interface portion, i.e., in an axial section of the housing which interacts with a complementary connector in order to create a mechanical connection between the two plastics housings are specified in DIN standard 72594-1 of October 2004. The part entitled "Road vehicles—50 Ohm High Frequency Interface (50Ω RF Interface)—Part 1: Dimensions and Electrical Requirements" of the aforementioned DIN norm 72594-1 defines plugs and sockets for an interface with an impedance of 50 Ohm for high frequency applications (50Ω RF Interface) in road vehicles and ensures communication to and from the vehicle. It defines dimensional and electrical requirements and properties and ensures their interchangeability. All the well-known automobile manufacturers use this standard. The content of this standard is defined by the FAKRA group.

The FAKRA group within the DIN standards institute represents regional, national and international standardization interests in the automotive industry. The responsibilities of FAKRA cover the creation of all norms relating to compatibility, interchangeability and safety for road vehicles under DIN 70010 (excluding agricultural tractors) regardless of whether these road vehicles are equipped with internal combustion engines, electric motors or hybrid drives. FAKRA also sets standards for the bodywork of these road vehicles (except communal vehicles, fire engines and ambulances). It is also responsible for standardizing all the equipment of the aforementioned vehicles and their superstructure and for standardizing freight containers (ISO containers). Standardization promotes rationalization and quality assurance in vehicle manufacturing and the environmental tolerability of the vehicle. It also contributes accordingly to current technology and science in order to enhance vehicle and traffic safety, to the advantage of manufacturers and consumers.

SUMMARY OF THE INVENTION

Bearing in mind the problems and deficiencies of the prior art, it is therefore an object of the present invention to improve a coaxial plug connector of the aforementioned type with regard to its reliability on assembly.

This aim is achieved according to the invention with a coaxial plug connector of the aforementioned type having the features characterized in the claims. Advantageous embodiments of the invention are described herein and in the claims.

The above and other objects, which will be apparent to those skilled in the art, are achieved in the present invention which is directed to a coaxial plug connector comprising an outer conductor part, an inner conductor part, a dielectric which holds the inner conductor part within and coaxial with the outer conductor part at a predetermined axial position, and a plug-side end for plugged electrical and mechanical connection of the inner conductor part and the outer conductor part to a respective inner conductor part and outer conductor part of a complementary coaxial plug connector, wherein the dielectric has an axial channel with a predetermined first radial diameter within which the inner conductor part is arranged, at or spaced apart from the plug-side end of the dielectric, the radial diameter of the channel tapers in the direction of the plug-side end from the first predetermined radial diameter to a second predetermined radial diameter, wherein the inner conductor part has at least one first diameter and one second diameter smaller than the first diameter and smaller than the second predetermined radial diameter of the channel of the dielectric, wherein the first diameter of the inner conductor part is chosen so that the inner conductor part fits within the first predetermined radial diameter of the channel and simultaneously, the first diameter of the inner conductor part is larger than the second predetermined radial diameter of the channel, forming a shoulder at an outer side of the inner conductor part at the point at which the first diameter of the inner conductor part gives way to the second diameter of the inner conductor part, wherein the shoulder is arranged at the outer side of the inner conductor part in the axial direction such that the inner conductor part is situated at the predetermined axial position within the outer conductor part when the shoulder of the inner conductor part rests against the taper of the radial diameter of the channel of the dielectric, including having at least one elevation provided on an outer side of the inner conductor part and, on an inner side of the dielectric which faces toward the channel, at least one recess is arranged and configured such that the elevation on the inner conductor part locks with the recess in the dielectric when the inner conductor part is pushed axially into the channel of the dielectric as far as the predetermined axial position.

The coaxial plug connector includes having the shoulder extend at the outer side of the inner conductor part in the peripheral direction over the whole periphery of the inner conductor part.

The coaxial plug connector may include a coded housing having in the interface region thereof mechanical dimensions which accord with the FAKRA standardization scheme for 50Ω RF Interface. It may comprise a coaxial socket end for connection with a complementary coaxial plug, or a coaxial plug end for connection with a complementary coaxial socket.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
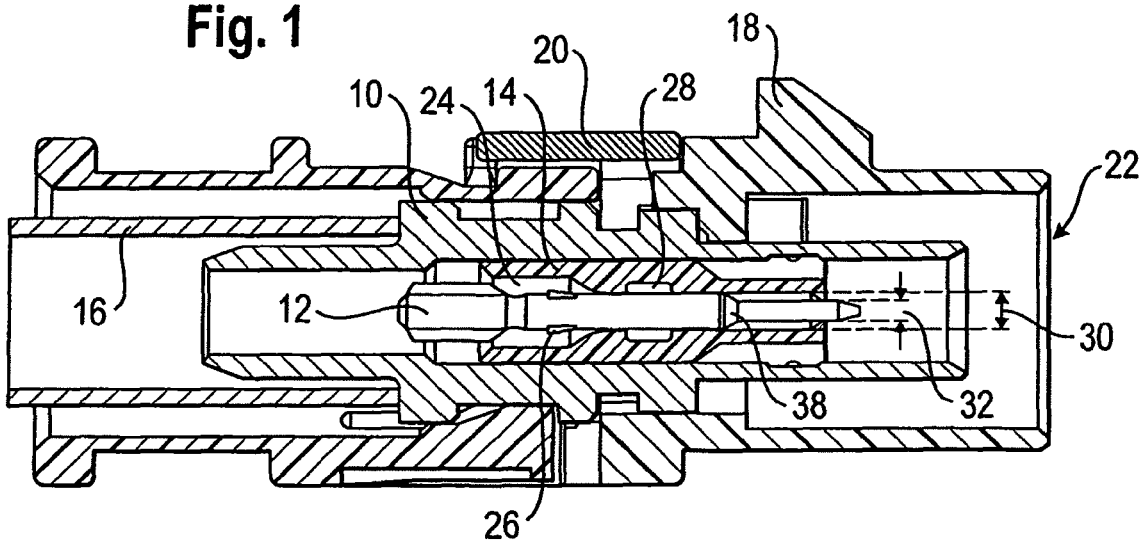
FIG. 1 shows a preferred embodiment of a coaxial plug connector according to the invention in a sectional view wherein an inner conductor part is inserted axially into a dielectric as far as a first axial position.
Figure 2:
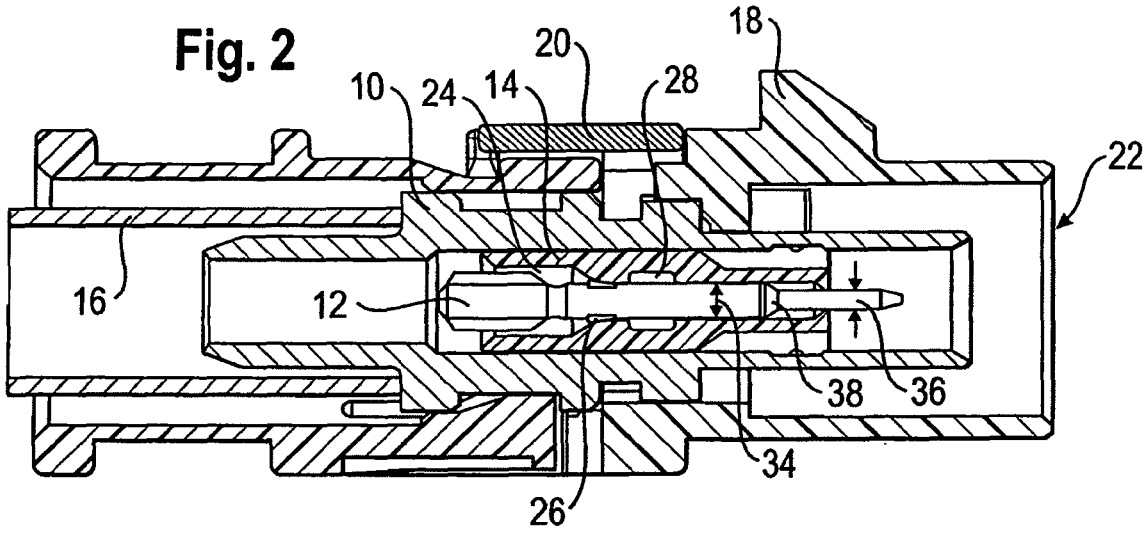
FIG. 2 shows the preferred embodiment of a coaxial plug connector according to the invention as shown in FIG. 1 in a sectional view, wherein the inner conductor part is inserted axially into the dielectric as far as a second axial position.
Figure 3:
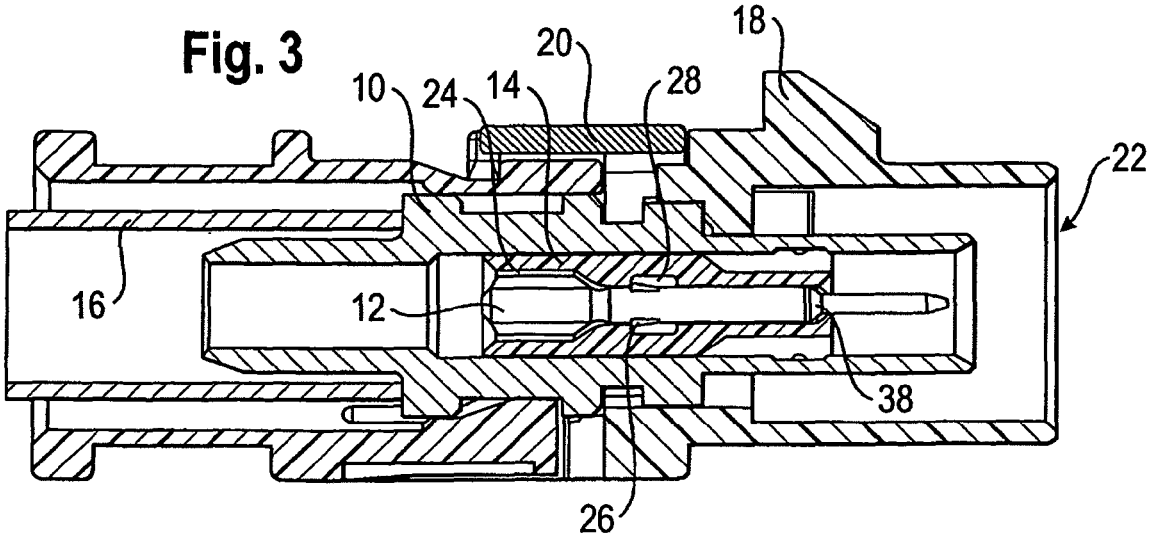
FIG. 3 shows the preferred embodiment of a coaxial plug connector according to the invention as shown in FIG. 1 in a sectional view, wherein the inner conductor part is inserted axially into the dielectric as far as a third axial position, wherein locking lugs on the outer side of the inner conductor part lock into recesses in an inner side of the dielectric.

In describing the preferred embodiment of the present invention, reference will be made herein to FIGS. 1-4 of the drawings in which like numerals refer to like features of the invention.

In a coaxial plug connector of the aforementioned type, it is provided according to the invention that at or spaced apart from a plug-side end of the dielectric, the channel for the inner conductor part is configured such that the radial diameter of the channel tapers in the direction of the plug-side end from the first predetermined radial diameter to a second predetermined radial diameter, wherein the inner conductor part has at least one first diameter and one second diameter which is smaller than the first diameter and smaller than the second predetermined radial diameter of the channel of the dielectric, wherein the first diameter of the inner conductor part is chosen so that the inner conductor part fits within the first predetermined radial diameter of the channel and simultaneously, the first diameter of the inner conductor part is larger than the second predetermined radial diameter of the channel, so that a shoulder is formed at an outer side of the inner conductor part at the point at which the first diameter of the inner conductor part gives way to the second diameter of the inner conductor part, wherein said shoulder is arranged at the outer side of the inner conductor part arranged in the axial direction such that the inner conductor part is situated at the predetermined axial position within the outer conductor part when the shoulder of the inner conductor part rests against the taper of the radial diameter of the channel of the dielectric.

This has the advantage that a push-through protection is available for the inner conductor part in the axial direction which can withstand large axial forces on assembly of the coaxial plug connector.

An additional function for the axially correct positioning of the inner conductor part is available in that at least one elevation is provided on an outer side of the inner conductor part and on an inner side of the dielectric facing toward the channel, at least one recess is arranged and configured such that the elevation on the inner conductor part locks with the recess in the dielectric when the inner conductor part is pushed axially into the channel of the dielectric as far as the predetermined position.

Suitably, the shoulder extends at the outer side of the inner conductor part in the peripheral direction over the whole periphery of the inner conductor part.

In a preferred embodiment, the coaxial plug connector also comprises a coded housing having in the interface region thereof mechanical dimensions which accord with the FAKRA standardization scheme for 50Ω RF Interface.

The preferred embodiment of a coaxial plug connector as shown in FIGS. 1 to 4 comprises an outer conductor part 10, an inner conductor part 12, a dielectric 14, a crimp sleeve 16, a coded housing 18 and a secondary securing device 20. The coaxial plug connector has a plug-side end 22 which is configured for electrical and mechanical connection of the inner conductor part 12 and the outer conductor part 10 with respectively an inner conductor part and an outer conductor part of a complementary coaxial plug connector (not shown).

Arranged in the dielectric 14 is an axial channel 24 for axially inserting the inner conductor part 12 into the end of the dielectric 14 facing away from the plug-side end 22. Formed on the outer side of the inner conductor part 12 are elevations in the form of locking lugs 26 and formed and arranged on an inner side of the dielectric 14 facing toward the channel 24 are corresponding recesses 28 such that the locking lugs 26 lock into the recesses 28 when the inner conductor part is situated in a predetermined axial position relative to the outer conductor part. In this predetermined axial position, the inner conductor part 12 extends into the plug-side end 22 such that predetermined connection dimensions are provided. On assembly of the coaxial plug connector, the inner conductor part 12 is pushed axially from the end facing away from the plug-side end 22 into the dielectric 14 until the locking lugs 26 tangibly and audibly lock into the recesses 28.

Figure 4:
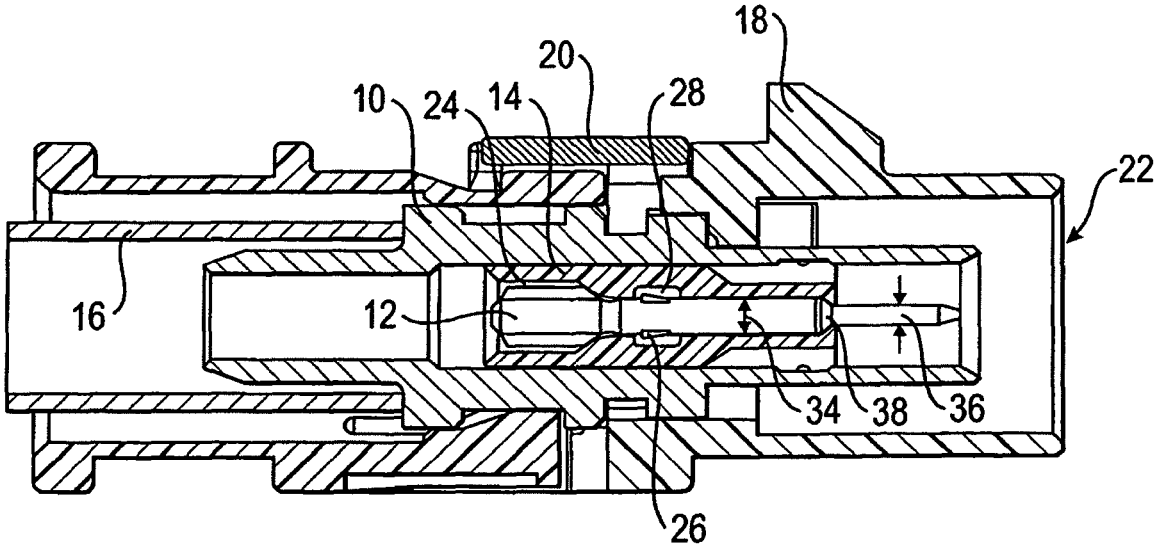
FIG. 4 shows the preferred embodiment of a coaxial plug connector according to the invention as shown in FIG. 1 in a sectional view, wherein the inner conductor part is inserted axially into the dielectric as far as a fourth axial position, wherein a shoulder formed on the outer side of the inner conductor part rests against a taper in the diameter of the dielectric.

The channel 24 of the dielectric has a first radial inner diameter 30 which tapers conically at the plug-side end 22 to a smaller second radial inner diameter 32. In addition, the inner conductor part 12 has a first outer diameter 34 which tapers to a smaller second outer diameter 36 such that a shoulder 38 is formed at the outer side of the inner conductor part 12. The first outer diameter 34 of the inner conductor part 12 is configured larger than the second radial inner diameter 32 of the channel 24. By this means, the shoulder 38 rests against the conical taper of the channel 24 at the plug-side end 22 thereof and then cannot be displaced further in the axial direction. The shoulder 38 on the inner conductor part 12 is arranged in the axial direction such that the inner conductor part 12 is situated at the predetermined axial position and the locking lugs 26 have already locked into the recesses 28 when the shoulder 38 comes to rest against the conical taper of the channel 24 at the plug-side end 22 thereof. This is shown in FIG. 4. In this manner, insertion of the inner conductor part 12 in the axial direction beyond the predetermined axial position in the direction of the plug-side end 22 is prevented, even if a very large axial force is applied. This ensures that the connection dimensions at the plug-side end 22 are always correct.

A coaxial cable (not shown) can be connected to the coaxial plug connector at the end of the coaxial plug connection opposing the plug-side end 22 having the crimp sleeve 16.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A coaxial plug connector comprising an outer conductor part, an inner conductor part, a dielectric which holds the inner conductor part within and coaxial with the outer conductor part at a predetermined axial position, and a plug-side end for plugged electrical and mechanical connection of the inner conductor part and the outer conductor part to a respective inner conductor part and outer conductor part of a complementary coaxial plug connector, wherein the dielectric has an axial channel with a predetermined first radial diameter within which the inner conductor part is arranged, at or spaced apart from the plug-side end of the dielectric, the first radial diameter of the channel tapers in the direction of the plug-side end from the first predetermined radial diameter to a second predetermined radial diameter, wherein the inner conductor part has at least one first diameter and one second diameter smaller than the first diameter and smaller than the second predetermined radial diameter of the channel of the dielectric, wherein the first diameter of the inner conductor part is chosen so that the inner conductor part fits within the first predetermined radial diameter of the channel and simultaneously, the first diameter of the inner conductor part is larger than the second predetermined radial diameter of the channel, forming a shoulder at an outer side of the inner conductor part at the point at which the first diameter of the inner conductor part gives way to the second diameter of the inner conductor part, wherein said shoulder is arranged at the outer side of the inner conductor part in the axial direction such that the inner conductor part is situated at the predetermined axial position within the outer conductor part when the shoulder of the inner conductor part rests against the taper of the radial diameter of the channel of the dielectric, having at least one elevation provided on an outer side of the inner conductor part and, on an inner side of the dielectric which faces toward the channel, at least one recess is arranged and configured such that the elevation on the inner conductor part locks with the recess in the dielectric when the inner conductor part is pushed axially into the channel of the dielectric as far as the predetermined axial position.

2. The coaxial plug connector of claim 1, having the shoulder extend at the outer side of the inner conductor part in the peripheral direction over the whole periphery of the inner conductor part.

3. The coaxial plug connector of claim 1, including a coded housing having in the interface region thereof mechanical dimensions which accord with the FAKRA standardization scheme for 50Ω RF Interface.

4. The coaxial plug connector of claim 1 comprising a coaxial socket end for connection with a complementary coaxial plug.

5. The coaxial plug connector of claim 1 comprising a coaxial plug end for connection with a complementary coaxial socket.

6. The coaxial plug connector of claim 2, including a coded housing having in the interface region thereof mechanical dimensions which accord with the FAKRA standardization scheme for 50Ω RF Interface.

7. The coaxial plug connector of claim 4, including having the shoulder extend at the outer side of the inner conductor part in the peripheral direction over the whole periphery of the inner conductor part.

8. The coaxial plug connector of claim 4, including a coded housing having in the interface region thereof mechanical dimensions which accord with the FAKRA standardization scheme for 50Ω RF Interface.

9. The coaxial plug connector of claim 5, including having the shoulder extend at the outer side of the inner conductor part in the peripheral direction over the whole periphery of the inner conductor part.

10. The coaxial plug connector of claim 5, including a coded housing having in the interface region thereof mechanical dimensions which accord with the FAKRA standardization scheme for 50Ω RF Interface.

* * * * *